US008573590B2

(12) United States Patent
Shimizu et al.

(10) Patent No.: US 8,573,590 B2
(45) Date of Patent: Nov. 5, 2013

(54) SHEET FINISHER AND IMAGE FORMING SYSTEM PROVIDED THEREWITH

(75) Inventors: Satoru Shimizu, Toyohashi (JP); Zen Kayaba, Toyohashi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 108 days.

(21) Appl. No.: 12/644,548

(22) Filed: Dec. 22, 2009

(65) Prior Publication Data

US 2010/0171257 A1 Jul. 8, 2010

(30) Foreign Application Priority Data

Jan. 7, 2009 (JP) ..... 2009-001425

(51) Int. Cl.
*B65H 31/00* (2006.01)

(52) U.S. Cl.
USPC ..... 271/209; 270/37

(58) Field of Classification Search
USPC ..... 271/209, 161; 270/37
See application file for complete search history.

(56) References Cited

U.S. PATENT DOCUMENTS 3,618,938 A * 11/1971 Pollak et al. ..... 271/66
3,761,080 A * 9/1973 Larson ..... 271/209
4,911,421 A * 3/1990 Hannon ..... 271/161
4,957,284 A * 9/1990 Brabant ..... 270/37
6,065,747 A * 5/2000 Khovaylo et al. ..... 271/209
6,149,045 A * 11/2000 Kadono ..... 226/196.1
2002/0033569 A1* 3/2002 Watanabe ..... 270/37
2003/0234485 A1* 12/2003 Gosslinghoff ..... 271/209
2009/0152788 A1* 6/2009 Kawaguchi ..... 270/37
2010/0007072 A1* 1/2010 Kamiya ..... 270/37

FOREIGN PATENT DOCUMENTS

FR 2569669 A1 * 3/1986
JP 06100225 A * 4/1994
JP 2004-83261 A 3/2004

* cited by examiner

*Primary Examiner* — Prasad Gokhale
(74) *Attorney, Agent, or Firm* — Holtz, Holtz, Goodman & Chick, PC

(57) ABSTRACT

In a sheet finisher which receives a sheet from an image forming apparatus, conducts a sheet finishing onto the sheet and feeds out the sheet, the sheet finisher includes: a stacking section which stores temporarily one or more sheets; and a sheet finishing section which conducts the sheet finishing onto the sheet stored in the stacking section. The stacking section having a first guide member which forms a stacking surface to guide the sheet, and a second guide member which faces the first guide member and is spaced apart from the first guide member by a predetermined distance, and is provided obliquely from a horizontal direction, and the stacking surface formed by at least a part of the first guide member, is formed to be curved in a direction perpendicular to a sheet conveyance direction.

9 Claims, 3 Drawing Sheets

SHEET FINISHER AND IMAGE FORMING SYSTEM PROVIDED THEREWITH

This application is based on Japanese Patent Application No. 2009-001425 filed on Jan. 7, 2009, which is incorporated hereinto by reference.

BACKGROUND OF THE INVENTION

The present invention relates to a sheet finisher that receives a sheet coming from an image forming apparatus, then, conducts sheet finishing on the sheet and feeds out the sheet and to an image forming system characterized to have the sheet finisher and an image forming apparatus that feeds a sheet into the sheet finisher, and in particular, to a sheet finisher having a stacking section that is arranged obliquely from the horizontal direction and stores one or more sheets temporarily and an image forming system.

With respect to the aforesaid stacking section that is arranged obliquely from the horizontal direction, it is aslant so that an empty weight of the sheet causes the sheet to slip down along a stacking surface to stop at a prescribed position, when a sheet is fed into it. In a circumference of the stacking section, there are arranged sheet finishing sections that conduct sheet finishing for the sheets stored in the stacking section.

The sheet finishing section includes a stapling section that staples a sheet bundle, a folding section that conducts center-folding for a sheet bundle or folds each sheet in three, an aligning section that aligns sheet bundles in a width direction or in a conveyance direction, or a punching section that punches a hole for a sheet bundle.

Further, on the stacking section, there is also arranged a positioning regulating member that moves a sheet vertically to position for conducting processing for a sheet at a determined position in the aforesaid sheet finishing section.

Since the stacking section of this kind is arranged obliquely, there is sometimes an occasion of buckling that sheets stored in the stacking section buckle, namely, the sheets are bent and do not line up straight on the stacking surface. If the sheets do not line up due to the buckling, it is impossible to conduct sheet finishing on the lined up sheet bundle because of slippage of sheets, in the case of processing carried out by a sheet finishing device arranged on the stacking section. The bucking of this kind takes place frequently on the lower side portion of sheets where each of the sheets receives its own weight, in particular.

In the past, there has been a construction having the structure wherein an elastic sheet such as PET is arranged on an inside of the stacking section, to press the sheet that has been fed into against the stacking surface, to prevent the buckling of this kind. However, when the number of sheets stored grows greater, elastic sheets that press the sheet become resistance against sheet conveyance, and there have been troubles that the sheet is not conveyed to the prescribed position to cause slippage.

In the technology disclosed in Unexamined Japanese Patent Application Publication No. 2004-83261, there are provided a tapping roller that aligns sheets by applying a pendulum motion on the stacking surface and a pressing roller that presses a sheet bundle by swinging from a standing by position to an operation position, for preventing the buckling of the sheet. In the constitution of this technology, the tapping roller aligns sheets in the conveyance direction by applying a pendulum motion for each sheet carried in, and after that, the pressing roller presses a bundle of sheets in the direction of the sheet.

The technology disclosed in the aforesaid Unexamined Japanese Patent Application Publication No. 2004-83261 is complicated in terms of the construction, to cause cost increase, which is a defect. In addition, the construction needs to be provided in the vicinity of the position for sheet carry-in for aligning sheets by a pendulum motion, which further requires more space, resulting in a restriction of a position of installation for acquiring a space.

SUMMARY OF THE INVENTION

An embodiment of the invention is as follows.

A sheet finisher that receives a sheet from an image forming apparatus and feeds the sheet out after conducting sheet finishing on the sheet, wherein the sheet finisher is characterized in that a stacking section that stores one or more sheets temporarily and a sheet finishing section that conducts sheet finishing on the sheet stored in the stacking section are provided, and the stacking section has a guide member (also referred to as a first guide member) that forms a stacking surface and a guide member (also referred to as a second guide member) that faces the aforesaid first guide member through a prescribed space, and is provided obliquely from the horizontal direction and the stacking surface formed by at least a part of the first guide member is formed to be curved in the direction perpendicular to the conveyance direction for sheets.

An image forming system characterized to have the sheet finisher described in the above and an image forming apparatus that feeds the sheet in the sheet finisher.

DETAILED DESCRIPTION OF THE PREFERRED EMBODIMENT

An embodiment of the invention will be explained as follows, referring to FIG. 1-FIG. 4.

(Image Forming System)

Figure 1:
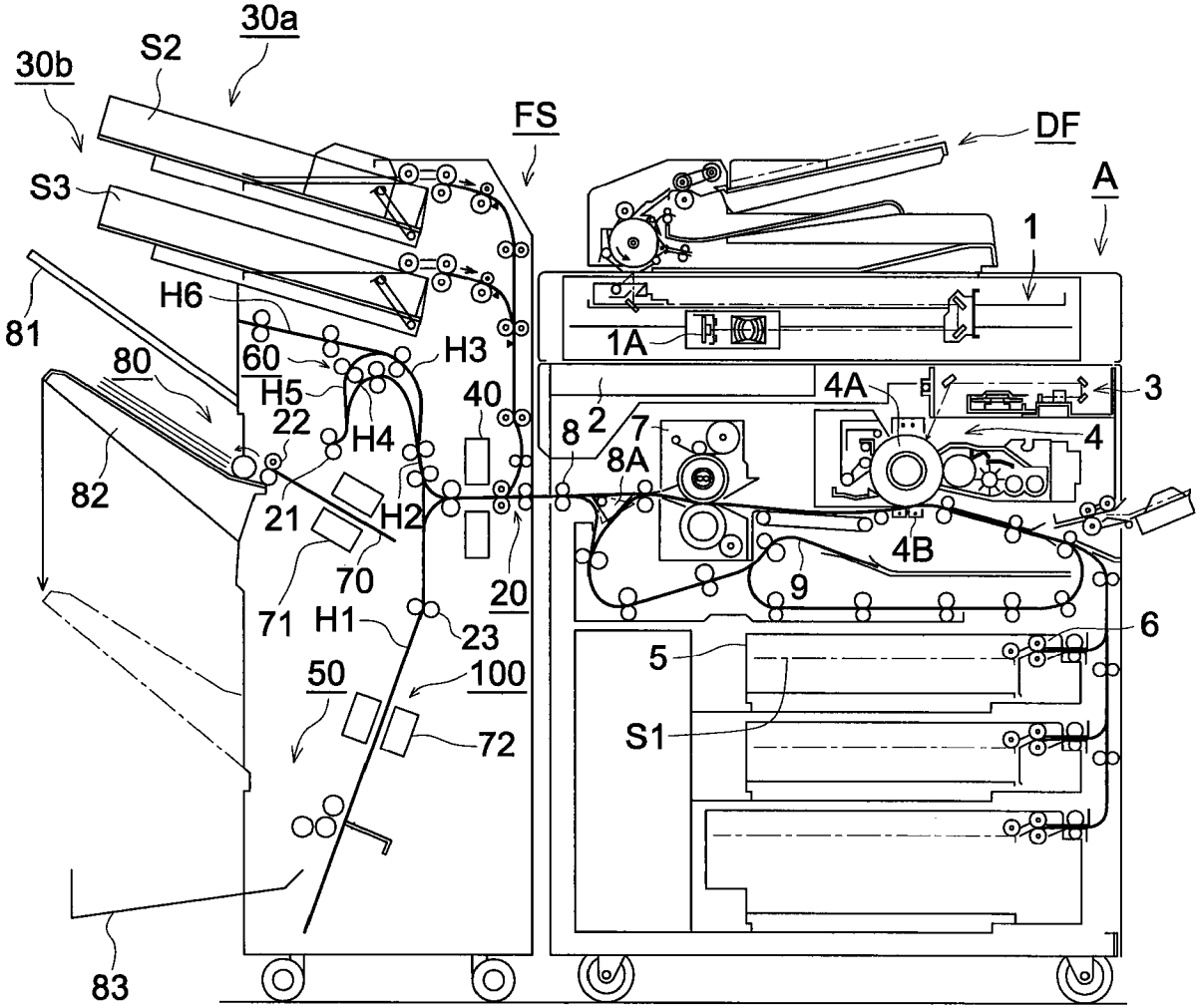
FIG. 1 is a schematic sectional view of an image forming apparatus main body and a sheet finisher to which the invention is applied.

FIG. 1 is a general view of an image forming system relating to an embodiment of the invention composed of image forming apparatus A and sheet finisher FS.

<Image Forming Apparatus A>

The illustrated image forming apparatus A is equipped with image reading section 1, image processing section 2, image writing section 3, image forming section 4, sheet feeding cassette 5, sheet feeding roller 6, fixing device 7, sheet ejection roller 8 and with automatic double-sided copy sheet feeding section 9.

On the upper portion of the image forming apparatus A, there is installed automatic document feeder DF. Further, on the left side of the image forming apparatus A in the illustration where sheet ejection roller 8 is positioned, there is connected sheet finisher FS.

Images on one side or both sides of a document placed on a document platen of automatic document feeder DF are scanned by an optical system of image reading section 1 that is conveyed along a conveyance path, to be read into CCD image sensor 1A.

Analog signals obtained through photoelectric conversion conducted by CCD image sensor 1A undergo various processes including analog processing, A/D conversion, shading correction and image compression processing, in image processing section 2, and then, are sent to image writing section 3.

A semiconductor laser is driven to emit light based on the image data sent to the image writing section 3, thus, photoreceptor drum 4A of image forming section 4 is illuminated and a latent image is formed thereon. In the image forming section 4, processes such as electrification, light exposure, development, transfer, separation and cleaning are carried out and a toner image is formed on the photoreceptor drum 4A.

Recording sheet S1 that is fed by sheet-feeding roller device 6 from sheet-feeding cassette 5 arrives at photoreceptor drum 4A where the toner image is transferred onto the recording sheet S1 by transfer section 4B. The recording sheet S1 carrying the toner image thereon undergoes fixing processing conducted by fixing device 7, and is fed into the sheet finisher FS from sheet ejection roller 8.

In the case of duplexing copying, the recording sheet S1 on which the image processing has been finished on its one side is fed into automatic double-sided copy sheet feeding section 9 by conveyance path switching plate 8A, and in image forming section 4, a toner image is transferred onto the reverse side to be fixed, and is fed into the sheet finisher FS from sheet ejection roller 8.

(Sheet Finisher FS)

Sheet finisher FS has therein sheet carry-in section 20, insertion sheet feeding sections 30*a* and 30*b* and a plurality of sheet finishing sections. The sheet finishing sections include punching section 40, folding section 50, superimposing section 60, corner stapling section 71, center stapling section 72 and ejection section 80.

Insertion sheet S2 is loaded in insertion sheet feeding section 30*a* and another insertion sheet S3 is loaded in insertion sheet feeding section 30*b*. Insertion sheets S2 and S3 are those such as book cover sheets and sheets for insert which are inserted in plural recording sheets S1 ejected from image forming apparatus A, and they can undergo punching processing and folding processing, in the same way as in the recording sheet S1. Incidentally, in the following explanation, recording sheet S1, insertion sheets S2 and S3 are called sheet S as a general name.

Insertion sheets S2 and S3 which are fed out of insertion sheet feeding sections 30*a* and 30*b* respectively are conveyed to sheet carry-in section 20 through a conveyance path that goes downward.

The punching section 40 is arranged at the downstream side of the sheet carry-in section 20 on the left side, to make a punched hole on sheet S.

Conveyance path H1 branched downward from the downstream side of the punching section 40 is connected to sheet stacking section 100 relating to the invention through conveyance rollers 23. On the sheet stacking section 100, there are arranged center stapling section 72 and folding section 50, which will be described in detail later.

The superimposing section 60 is arranged at the downstream side of conveyance path H2 branched upward from the downstream side of the punching section 40, and it is equipped with conveyance paths H3, H4 and H5.

The superimposing section 60 causes succeeding sheets S including sheets for the second set and thereafter to stand by on conveyance paths H3, H4 and H5, to secure a period of time for conducting stapling processing for preceding sheet S.

A conveyance path positioned at the downstream side of the conveyance path H2 is branched into conveyance paths curved doubly, and they are divided into inside conveyance path H4 and outside conveyance paths H3 and H5.

On an exit of the inside conveyance path H4 that is branched from the conveyance path H2 and is curved, there are provided conveyance rollers 21, and when stapling processing is conducted, sheet S for the first set is fed into stacking section 70 successively through the conveyance paths H2 and H4 and through the conveyance rollers 21 to be stapled at corner stapling section 71.

When the first sheet of sheets S for the second set and thereafter has been conveyed, a leading edge of the sheet is stopped under the condition where the rotation of the conveyance rollers 21 is stopped, and the conveyance rollers 21 cause the leading edge of the sheet to stand by while touching a nip portion of the conveyance rollers 21.

Though the sheet S which has been conveyed through conveyance path H4 stands by while its leading edge is touching the conveyance rollers 21, sheet S following the aforesaid sheet S enters conveyance path H3 from conveyance path H2, and arrives at the conveyance rollers 21 through conveyance path H5. When the preceding sheet S and the following sheet S are superimposed on each other while their leading edges are touching the conveyance rollers 21, the conveyance rollers 21 rotate to feed the two sheets into stacking section 70 by conveying them together. As stated above, sheets S for the second set and thereafter are caused to stand by at superimposing section 60 until the moment when the stapling processing for the preceding bundle of sheets is terminated, thus, the stapling processing is carried out without lowering productivity of image forming apparatus A.

Conveyance path H3 located at the downstream side of conveyance path H2 is further branched into conveyance path H5 and conveyance path H6. The conveyance path H6 is one to eject sheet S to fixed sheet ejection tray 81 that constitutes a part of ejection section 80, and the fixed sheet ejection tray 81 is arranged at a position to project out of the sheet finisher FS at the downstream side of conveyance path H6, and it is used when sheets S in a small amount is stacked.

The ejection section 80 further has elevating sheet ejection tray 82 and lower sheet ejection tray 83 which will be described later, and sheet ejection rollers 22, stacking section 70, corner stapling section 71 and an unillustrated aligning mechanism are arranged between the conveyance rollers 21 and elevating sheet ejection tray 82.

The sheet ejection rollers 22 are composed of a pair of rollers, and when sheets are not ejected, the paired rollers are apart from each other, while when sheets are ejected, the paired rollers come in contact with each other to eject sheet S onto the elevating sheet ejection tray 82.

Sheet S to be conveyed by the conveyance rollers 21 travels in the direction to the left in the diagram between the sheet ejection rollers 22 which are separated from each other, and when a trailing edge of the sheet S leaves the conveyance rollers 21, the sheet S falls on the stacking section 70 to slide down along the inclined stacking section 70, and the sheet S hits a stopper (not shown) to be stopped on the stacking section 70. Sheets S are ejected successively, and when sheets S in a quantity of established number are stacked on the stacking section 70, the corner stapling section 71 operates to conduct stapling on an edge surface of the sheets s that is closer to the stopper.

The sheets S thus stapled are pushed up by the aforesaid stopper, to move to the left on the stacking section 70. In this case, the paired rollers constituting the sheet ejection rollers 22 come in contact with each other to nip the sheet S to convey it and to eject it to the elevating sheet ejection tray 82.

When large quantities of images are formed without sheet finishing, sheets S are ejected from the sheet carry-in section 20 to the elevating sheet ejection tray 82 through the conveyance paths H2 and H4, and the elevating sheet ejection tray 82 moves downward as shown with chain lines in the drawing so that a topmost surface of the ejected sheets S may keep the fixed height constantly. Therefore, thousands of sheets can be stacked on the elevating sheet ejection tray 82.

Sheet stacking section 100 is arranged obliquely from a horizontal direction at the downstream side of the conveyance rollers 23, and it has therein a plurality of guide members to guide sheets S and regulating members, center stapling section 72 and folding section 50, to conduct processing sheets in various modes including a center-folding mode, a center-folding and center stapling mode and three-folding mode for one or more sheets S, and to eject sheets to lower sheet ejection tray 83.

Figure 2:
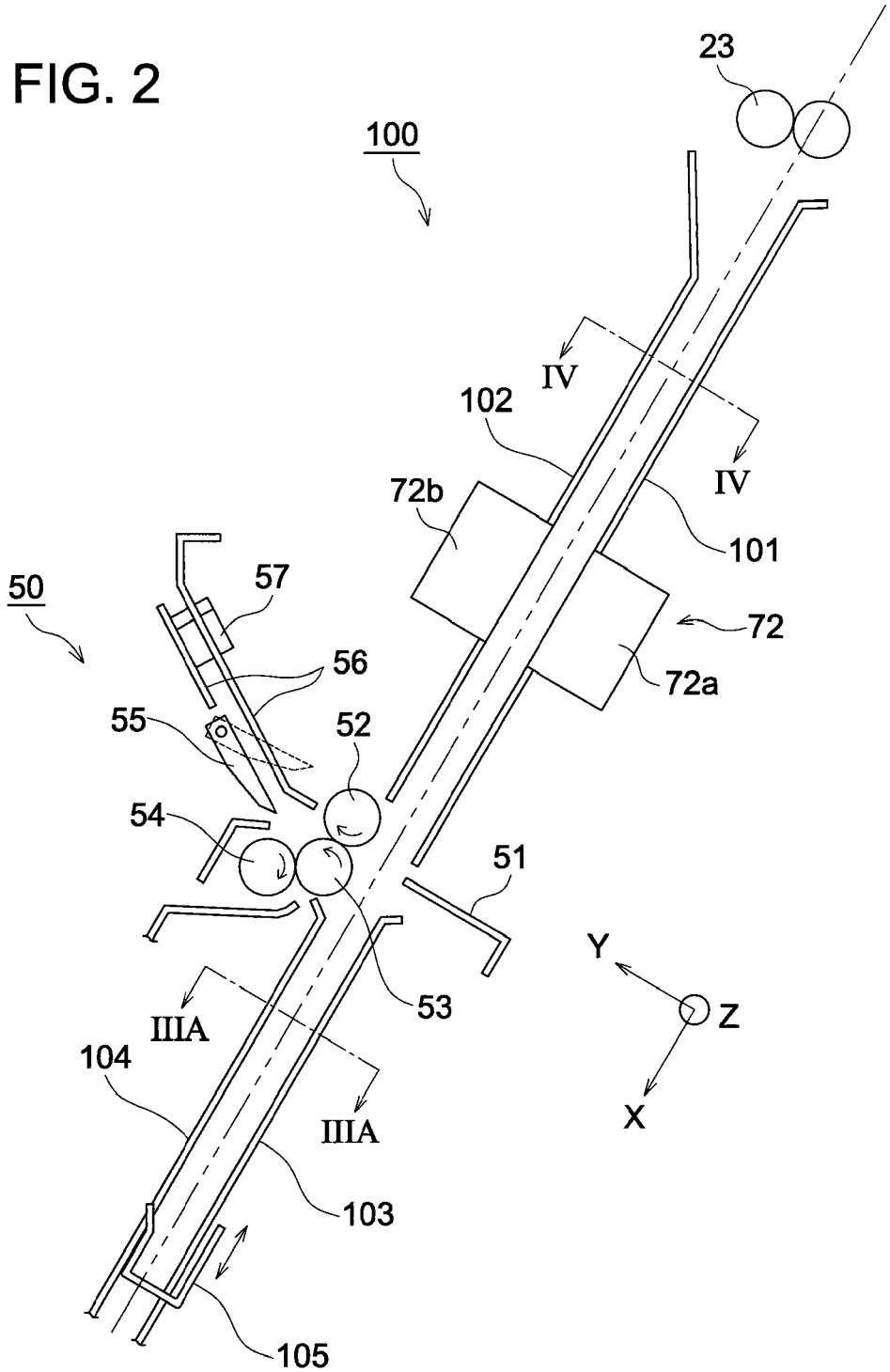
FIG. 2 is a principal part enlarged sectional view of the stacking section of the sheet finisher.

FIG. 2 is a schematic sectional view of sheet stacking section 100.

A two-dot chain line in FIG. 2 represents a virtual plane, and it is drawn for the explanation which will be given later, and sheet S is mostly carried in from an obliquely upper portion downward obliquely along the virtual plane. Further, as is shown on the lower portion on the right in the drawing, it is assumed that X direction is a direction toward the lower portion obliquely along the virtual plane, Y direction is a direction that is perpendicular to the X direction on a page surface and Z direction is a direction that is perpendicular upward to the page surface, in the following explanation.

Guide members constituting the sheet stacking section 100 includes upstream side guide members 101 and 102 and downstream side guide members 103 and 104, and in the middle of the upstream side guide members 101 and 102, there is positioned center stapling section 72, and between the upstream side guide members and the downstream side guide members, there is positioned folding section 50. Incidentally, an unillustrated sheet width aligning member is arranged at a proper location of the upstream side guide members 101 and 102, to conduct alignment in the width directions (Z direction and its opposite direction) of sheet S, and an explanation for the foregoing will be omitted here.

On the downstream side of the folding section 50, there is provided regulating member 105 that can travel along the downstream side guide members 103 and 104. The regulating member 105 is one to regulate a lower end of sheet S to be at the prescribed position, and it is moved in accordance with a sheet size.

The upstream side guide member 101 and the downstream side guide member 103 are positioned to be on the bottom side of the sheet stacking section 100 (opposite Y direction side), and they constitute a stacking surface along which sheets S slide down to be stacked. Further, the upstream side guide member 102 is arranged to face the upstream side guide member 101 with a fixed space in-between, and the downstream side guide member 104 is arranged to face the downstream side guide member 103 with a fixed space in-between.

The center stapling section 72 is composed of staple-receiving mechanism 72*a* and staple-nailing mechanism 72*b*, and when a central portion of a bundle of sheets S in the conveyance direction is positioned by regulating member 105, the center stapling section 72 operates to conduct center-stapling for sheets S.

The folding section 50 is equipped with folding plate 51, folding upper roller 52, folding lower roller 53, second folding roller 54, conveyance path switching member 55, guide member 56 that constitutes folding introduction device and with leading edge stop member 57, and it conducts two-fold processing or three-fold processing for sheet S.

In the two-fold processing, the regulating member 105 is moved first so that a central portion of sheet S may be positioned at a location of the folding plate 51. Then, the folding plate 51 inserts the sheet S between the folding upper roller 52 and the folding lower roller 53, while the folding upper roller 52 and the folding lower roller 53 are rotating. Since the folding upper roller 52 and the folding lower roller 53 are urged by an unillustrated spring member so that they may be pressed each other, the sheet S is folded at its central portion to form a crease, and it is ejected to lower sheet ejection tray 83 through a lower portion of the conveyance path switching member 55 that is located at a position shown by broken lines.

In the case of the three-fold processing, the conveyance path switching member 55 is set to the position shown with solid lines. Then, sheet S undergoes folding processing in the same way as in the two-fold processing at the position corresponding to a length equivalent to one-third of a length of the sheet S, and then, the sheet S is moved to be guided to the guide member 56 along the upper surface of the conveyance path switching member 55, with a crease on the sheet S that serves as the forefront. In this case, the leading edge stop member 57 is located at a prescribed position corresponding to a sheet size, and the leading edge stop member 57 stops the crease on the leading edge of the sheet S.

Under the condition that the leading edge of the sheet S is stopped, when the folding upper roller 52, the folding lower roller 53 and the second folding roller 54 are further rotated, the sheet S is bent and curved to be inserted between the folding lower roller 53 and the second folding roller 54, thus, the second folding processing is carried out. Then, the sheet S is ejected to lower sheet ejection tray 83 through the lower part of the second folding roller 54.

On the sheet stacking section 100, sheets S are stacked for the aforesaid stapling processing and for the folding processing. However, in the conventional construction of the sheet stacking section, the empty weight of the sheet S causes the sheet S to buckle, resulting in an occasion wherein sheets S have not been aligned satisfactorily, and sheet bundles after sheet finishing processing have become uneven.

The invention is one wherein a guide member that constitutes sheet stacking section 100, in particular, stacking surface a formed by downstream side guide members 103 and 104 is constituted so that sheet S may be curved downward on both sides of the sheet in the directions (Z direction and its opposite directions) that is perpendicular to the conveyance direction for sheet S, in order to solve the problem of this kind for buckling of sheet S.

Figure 3A:
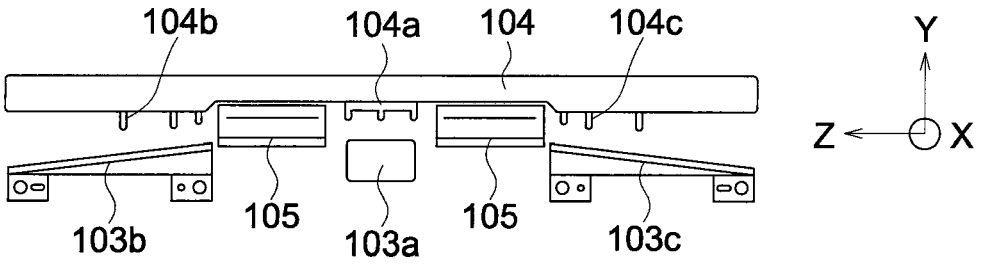
FIG. 3 is a sectional view taken on line IIIA-IIIA in FIG. 2.
Figure 3B:
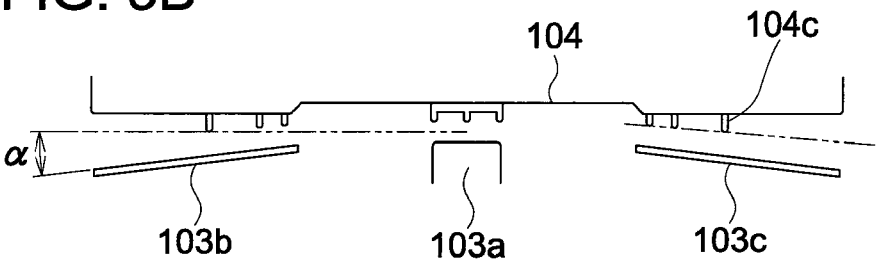

Each of FIGS. 3A-3B is a sectional view of downstream side guide member section taken on line IIIA-IIIA in FIG. 2, and FIG. 3B is an abridged sectional view wherein principal parts only in FIG. 3A are displayed.

In FIGS. 3A-3B, downstream side guide member 103 that forms a stacking surface among downstream side guide members is composed of downstream side guide member 103*a* at the center, and of downstream side guide members 103*b* and 103*c* respectively on the left and the right in the Z direction. Each of these downstream side guide members 103*b* and 103*c* is tilted by angle $\alpha$ from a virtual plane shown with a two-dot chain line as shown on the left side in FIG. 3B, and the angle $\alpha$ is set to 4° in the embodiment of the invention.

On the other hand, downstream side guide member 104 has on its inside portion central rib 104*a*, left side ribs 104*b* and right side ribs 104*c*. A height of each of the left side ribs and the right side ribs grows greater toward an outer side. A height of the rib is one that forms a space that is almost the same as the tilted surface of the downstream side guide member 103, as shown on the right side in FIG. 3B. These ribs 104*a*, 104*b* and 104*c* form a guide surface that is curved in the same direction as that for the stacking surface.

In FIG. 3A, the regulating members 105 are positioned on the left side and the right side of the rib 104*a*, and they move in the X direction and its opposite direction to regulate leading edges of sheets S stacked between downstream side guide members 103 and 104 to the prescribed position.

Figure 4:
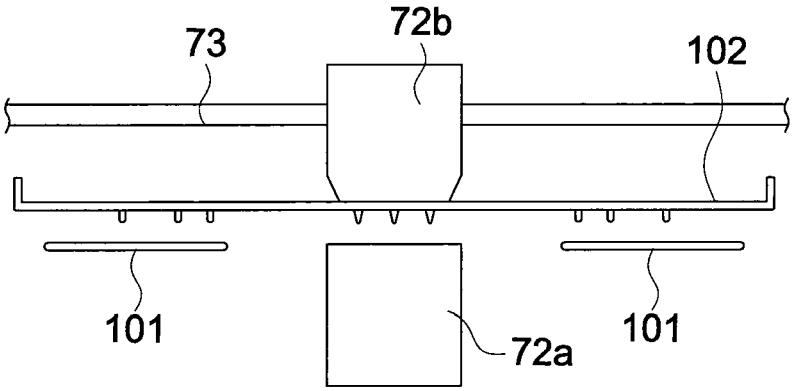
FIG. 4 is a sectional view taken on line IV-IV in FIG. 2.

FIG. 4 is a sectional view of an upstream side guide member taken on line IV-IV in FIG. 2. In the drawing, upstream side guide member 101 is constituted to be in parallel with a virtual plane, and in the same way, upstream side guide member 102 also has ribs at the center and in the left and right sides, and heights of the ribs are the same.

In FIG. 4, although the center stapling section 72 is illustrated to be at the center in the drawing, it moves to the left and to the right in the case of stapling processing to conduct stapling processing at two locations. In the drawing, guide rod 73 for this movement is illustrated only on staple-nailing mechanism 72*b* side.

Sheet S fed into sheet stacking section 100 by the conveyance rollers 23 advances downward while being guided by a flat stacking surface of the upstream side guide member 101, and then, it slides down along the stacking surface when a trailing edge of the sheet S leaves the conveyance rollers 23. Then, when a leading edge side of the sheet S enters a space between the downstream side guide members 103 and 104, both sides of the sheet S are curved by the empty weight of the sheet S, following the stacking surfaces which are both sides hanging down of the downstream side guide member 103. In addition, ribs on the downstream side guide member 104 accelerate curving of the sheet S.

The sheet S advances to the position of the regulating member 105 while being guided by the guide member, and the sheet S is stacked at that position to be in the state where the sheet S is curved along the stacking surface. The sheet S is curved along a shape of curvature of the guide member, resulting in an improvement of stiffness in the conveyance direction of the sheet S, thus, occurrence of buckling can be prevented.

It is preferable that angle $\alpha$ for downstream side guide members 103*b* and 103*c* to be tilted is 4° or more. This angle is one confirmed through experiments by the inventors of the present invention, and when the angle was less than 4°, there was an occasion where the sheet S was not curved sufficiently and buckling occurred. The upper limit of the angle is about 4° plus several degrees, though this value varies slightly depending on dimensions of a sheet stacking section and on types of sheets.

Further, the reason why the guide member that curves sheet S is only the downstream side guide member is to secure accuracy of sheet finishing by aligning sheets S flatly in the case of sheet finishing. However, it is also possible to employ the structure wherein the upstream side member is also tilted similarly to curve the sheet S, depending on the structure of the sheet finishing section.

Though the guide member 103 is made to be of the split construction in the embodiment described above, it is also possible to employ the construction wherein a guide member in a body is cut off by an amount equivalent to a portion of a range of movement of regulating member 105, depending on a range of movement of the regulating member 105.

Though the aforesaid sheet finisher FS has been explained in the form of connection with image forming apparatus A, the aforesaid sheet finisher FS can naturally be applied on the sheet finishing section, when a sheet finishing section is provided in the image forming apparatus main body.

As stated above, in the sheet finisher of the invention, buckling of sheet can be prevented by the simple construction that does not take a space and is low cost, because stiffness of the sheet is increased by curving the sheet, namely, by curling the sheet.

What is claimed is:

1. A sheet finisher which receives a sheet from an image forming apparatus, conducts sheet finishing on the sheet, and feeds out the sheet, the sheet finisher comprising:

a stacking section which temporarily stores at least one sheet; and a sheet finishing section which conducts the sheet finishing on the sheet stored in the stacking section, wherein the stacking section includes a first guide member which forms a stacking surface to guide the sheet, and a second guide member which faces the first guide member and is spaced apart from the first guide member, and the stacking section is positioned obliquely with respect to a horizontal direction, and wherein the first guide member comprises:

an upstream portion at which the stacking surface is flat along a sheet conveyance direction and flat across an entire width of the sheet along a sheet width direction that is perpendicular to the sheet conveyance direction; and a downstream portion that includes a center portion which is provided along the sheet conveyance direction and downwardly angled side portions which are positioned adjacent to the center portion and angled downwardly with respect to the center portion in a direction perpendicular to the sheet conveyance direction, wherein the downwardly angled side portions are positioned to support lateral sides of the sheet in the width direction of the sheet, and wherein the center portion and the downwardly angled side portions extend obliquely with respect to the horizontal direction along the sheet conveyance direction, wherein the downstream portion of the first guide member is only provided downstream of the sheet finishing section in the sheet conveyance direction, and the sheet finishing section is not provided at the downstream portion, wherein a downstream portion of the second guide member forms a guide surface having a center portion corresponding to the center portion of the first guide member, and downwardly angled side portions which are angled in the same direction as the downwardly angled side portions of the first guide member, and wherein the center portion of the guide surface of the second guide member is formed by a plurality of ribs of a same height, and each of the downwardly angled side portions of the guide surface of the second guide member is formed by a plurality of ribs that increase in height outwardly from the center portion.

2. The sheet finisher of claim 1, wherein an upstream portion of the second guide member forms a flat guide surface facing the flat stacking surface of the upstream portion of the first guide member.

3. The sheet finisher of claim 2, wherein the flat guide surface of the upstream portion of the second guide member is formed by a plurality of ribs of a same height.

4. A sheet finisher which receives a sheet from an image forming apparatus, conducts sheet finishing on the sheet, and feeds out the sheet, the sheet finisher comprising:

a stacking section which temporarily stores at least one sheet; and a sheet finishing section which conducts the sheet finishing on the sheet stored in the stacking section, wherein the stacking section includes a first guide member which forms a stacking surface to guide the sheet, and a second guide member which faces the first guide member and is spaced apart from the first guide member, and the stacking section is positioned obliquely with respect to a horizontal direction, wherein the first guide member comprises:

an upstream portion at which the stacking surface is flat along a sheet conveyance direction and flat across an entire width of the sheet along a sheet width direction that is perpendicular to the sheet conveyance direction; and a downstream portion that includes a center portion which is provided along the sheet conveyance direction and downwardly angled side portions which are positioned adjacent to the center portion and angled downwardly with respect to the center portion in a direction perpendicular to the sheet conveyance direction, wherein the downwardly angled side portions are positioned to support lateral sides of the sheet in the width direction of the sheet, wherein a downstream portion of the second guide member forms a guide surface having a center portion corresponding to the center portion of the first guide member, and downwardly angled side portions which are angled in the same direction as the downwardly angled side portions of the first guide member, and wherein the center portion of the guide surface of the second guide member is formed by a plurality of ribs of a same height, and each of the downwardly angled side portions of the guide surface of the second guide member is formed by a plurality of ribs that increase in height outwardly from the center portion.

5. The sheet finisher of claim 4, wherein an angle of downward inclination of the downwardly angled side portions is at least 4 degrees with respect to a virtual flat plane that is parallel with the center portion.

6. The sheet finisher of claim 4, wherein the sheet finishing section is arranged at an upstream portion of the stacking section, where the upstream portion of the first guide member is positioned.

7. An image forming system comprising:

the sheet finisher of claim 4; and the image forming apparatus which feeds a sheet to the sheet finisher.

8. The sheet finisher of claim 4, wherein an upstream portion of the second guide member forms a flat guide surface facing the flat stacking surface of the upstream portion of the first guide member.

9. The sheet finisher of claim 8, wherein the flat guide surface of the upstream portion of the second guide member is formed by a plurality of ribs of a same height.

* * * * *